US010030482B2

(12) United States Patent
Leggett

(10) Patent No.: US 10,030,482 B2
(45) Date of Patent: Jul. 24, 2018

(54) VALVE MECHANISM HAVING TOOL TRAP

(71) Applicant: NATIONAL OILWELL VARCO, L.P.

(72) Inventor: Henry H. Leggett, Livingston, TX (US)

(73) Assignee: National Oilwell Varco. L.P., Houston, TX (US)

( * ) Notice: Subject to any disclaimer, the term of this patent is extended or adjusted under 35 U.S.C. 154(b) by 618 days.

(21) Appl. No.: 14/622,137

(22) Filed: Feb. 13, 2015

(65) Prior Publication Data

US 2015/0233212 A1 Aug. 20, 2015

Related U.S. Application Data

(60) Provisional application No. 61/941,395, filed on Feb. 18, 2014.

(51) Int. Cl.
*E21B 41/00* (2006.01)
*E21B 33/03* (2006.01)

(52) U.S. Cl.
CPC ..... *E21B 41/0021* (2013.01); *E21B 33/03* (2013.01)

(58) Field of Classification Search
CPC .... E21B 33/068; E21B 40/00; E21B 41/0021; E21B 33/06; E21B 33/061
See application file for complete search history.

(56) References Cited

U.S. PATENT DOCUMENTS 1,669,655 A * 5/1928 Cormier ..... E21B 41/0021 166/70
2,350,863 A * 6/1944 Bailey ..... E21B 40/00 166/70
2,710,064 A * 6/1955 Osmun ..... E21B 41/0021 166/70
3,435,895 A * 4/1969 Lee ..... E21B 33/072 166/70
4,281,722 A * 8/1981 Tucker ..... E21B 10/66 166/84.1
4,299,280 A * 11/1981 Greer ..... E21B 33/072 166/113
4,907,650 A * 3/1990 Heinonen ..... E21B 33/08 166/80.1
5,203,408 A * 4/1993 Boscher ..... E21B 19/10 166/70
8,042,617 B2 * 10/2011 Bowles ..... E21B 33/072 166/241.5
2008/0236838 A1 * 10/2008 Smith ..... E21B 33/072 166/373

(Continued)

OTHER PUBLICATIONS

Bellingacci, F., International Search Report for International Patent Application No. PCT/US2013/015880, European Patent Office, dated Sep. 9, 2015.

(Continued)

*Primary Examiner* — Blake E Michener
(74) *Attorney, Agent, or Firm* — Conley Rose, P.C.

(57) ABSTRACT

The present invention discloses a novel Tool Trap that in at least some embodiments can provide means for debris to fall over a Gate into a peripheral Sump and means to move a Gate laterally from a Center Tube to clear debris from the Center Tube that might restrict the Gate from rotating between an open position and a closed position.

16 Claims, 3 Drawing Sheets

(56) References Cited

U.S. PATENT DOCUMENTS

2012/0273278 A1* 11/2012 Zhu ..... E21B 37/00
175/206
2013/0327536 A1* 12/2013 Alexander ..... E21B 29/08
166/373
2014/0360716 A1* 12/2014 Machina ..... E21B 33/068
166/96.1

OTHER PUBLICATIONS

Bellingacci, F., Written Opinion for International Patent Application No. PCT/US2013/015880, European Patent Office, dated Sep. 9, 2015.

* cited by examiner

VALVE MECHANISM HAVING TOOL TRAP

CROSS REFERENCE TO RELATED APPLICATIONS

This application claims the benefit of U.S. Provisional Application Ser. No. 61/941,395, filed Feb. 18, 2014, entitled "Valve Mechanism Having Tool Trap."

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to the tool traps. Specifically, the disclosure relates to tool traps for valves restricting the debris from falling downhole.

Description of the Related Art

After oil/gas wells are drilled and completed, a wellhead remains on the well connected with its tubing annulus and casing annulus. The wellhead allows selective pressurization or depressurization of them for safety reasons and/or to allow various services to be performed within the well. Wellheads comprise valves having ID's slightly greater than the tubing ID, which are mounted vertically to open and close the bore of the center-most pipe string generally known as the tubing. The tubing extends down to the production zone to convey the oil and/or gas to the surface. During a typical well's producing life, various services such as plugging, logging, running special tools in or out, latching and unlatching down-hole devices. These services are most often done by running tools down-hole on wire-lines, supported by related equipment such as tool traps that prevent unwanted objects from falling down-hole.

A conventional tool trap is disclosed in columns 2-4 of U.S. Pat. No. 3,435,895 and shown in FIGS. 2 and 3, having the following members most pertinent to the present application: body 10; movable gate 11; gate opening means annular hydraulic piston 14; springs 18*a* and 18*b* to automatically close the gate after upward passage of a tool, if there is no fluid pressure on the piston. Although numerous Tool Traps are marketed today, they appear to have only one substantial improvement over the '895 patent, that is, an extension of the '895 patent's hinge pin 12 through the body wall 10 to allow independent manual opening and closing of the gate. No prior art known even addresses: debris falling on top of the gate that prevents opening of the gate; accumulation of debris around the gate that prevents closing of the gate; or prevention of debris falling down-hole that may prevent tools from working properly. Most Tool Traps of the prior art have little or no area around the bore for debris to accumulate and no known Tool Traps have means to prevent debris from falling downhole where it may foul workings of the wire-line tools.

Therefore, there remains a need for an improved tool trap to accommodate unwanted debris.

BRIEF SUMMARY OF THE INVENTION

The present invention discloses a novel Tool Trap that in at least some embodiments, can provide means for debris to fall over a Gate into a peripheral Sump and means to move a Gate laterally from a Center Tube to clear debris from the Center Tube that might restrict the Gate from rotating between an open position and a closed position. The Tool Trap improves over prior art by providing one or more of the following: (1) reduce debris from lodging on top of the Gate that may prevent it from opening; (2) move debris that may fall on top of the Gate; (3) reduce debris from accumulating around the bore of the Sump that may prevent the Gate from closing; (4) accumulate debris that may fall on the Gate in a way that does not affect operations of the wire-line tools; (5) allow for easy removal of accumulated debris; and (6) provide means for accomplishing those main objectives without having to (a) stop the well service operation, (b) depressurize, and (c) disassemble the well-head, (d) remove the debris, and (e) then reverse procedures (a-c).

Should debris fall on the sloped Gate top, it will most often be diverted by the sloped top of the Gate into the debris Sump surrounding the Center Tube, away from the top edge of the Center Tube where the Gate rests when closed, which otherwise would have kept the Gate from closing were the debris adjacent the Center Tube.

If debris not configured to be diverted into the Sump falls on top of the Gate and lodges there, then the Rod Guide may be turned to retract the Gate laterally away from the bore, which will cause the debris to fall aside into the Sump as the Gate slides out from beneath it, as the inner wall of the Tool Trap prevents lateral movement of the debris. The Rod Guide may then be turned the opposite direction to move the gate back into operating position. It is possible that some debris may fall down-hole the same as it does in traps of prior art, but since the Sump cross-sectional area is much greater than the bore area of the Center Tube, most debris should fall into the Sump.

The Sump may be cleaned easily and quickly while the Tool Trap is still mounted on the wellhead, by removing the top connection, which exposes the Center Tube and Sump area, as opposed to Tool Traps of prior art that have top openings smaller than the area of the bore of the Center Tube.

To insure proper operation of the Gate, means are provided to stop inward movement of the Gate at the precise operating position, without restricting movement of the Gate between open and closed position. When in operating position, the Gate may be rotated between open and closed positions automatically by a rising tool, or by actuation of the Axle of the Gate.

The present disclosure provides a Tool Trap, comprising: a Body (1) with a first Bore (19) and a second Bore (9); a rotatable Gate (8) positioned to selectively open and close within the first Bore and over the second Bore; and a Gate Retraction Assembly (100) affixed to the Body. The Gate Retraction Assembly comprises: a Leveler (10) having a Bore (54); a Rod Eye (7) affixed to the Gate and disposed in the Bore (54); and a Rod (6) affixed to the Rod Eye and configured to actuate the Gate laterally between its operating position across the Bore (9) and its retracted position.

The present disclosure also provides a Tool Trap, comprising: a Body (1) with a Bore (9); a rotatable Gate (8) positioned to selectively open and close over the Bore (9); and a Sump (34) formed around the Bore (9) and configured to receive debris in the Body.

The present disclosure further provides a method of restricting debris from entering a well, comprising: coupling a Tool Trap to the well having a Body (1) with a first Bore (19) and a second Bore (9); a rotatable Gate (8) positioned to selectively open and close within the first Bore and over the second Bore; and a Gate Retraction Assembly (100) affixed to the Body, with the Gate Retraction Assembly comprising a Leveler (10) having a Bore (54); a Rod Eye (7) affixed to the Gate and disposed in the Bore (54); and a Rod (6) affixed to the Rod Eye, and enabling an operator to selectively actuate the Gate laterally between an operating position across the Bore (9) and a retracted position away from the Bore (9).

DETAILED DESCRIPTION

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Further, various parts are illustrated as separate parts but move together as a unit, and therefore depending on manufacturing capabilities, expense, and other factors can be made as individual parts or as unitary combined parts.

Figure 1:
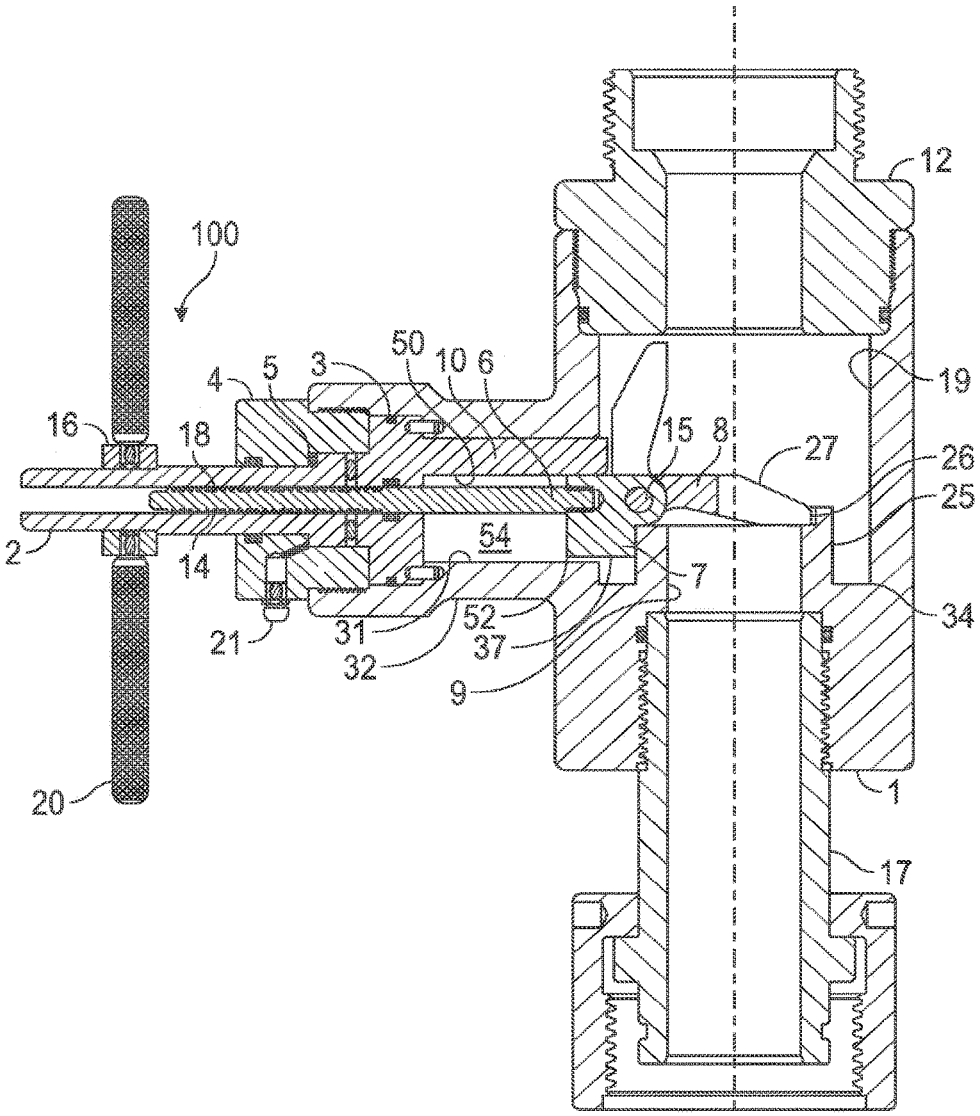
FIG. 1 is a schematic vertical cross sectional view of an exemplary Tool Trap in accordance with the present invention.
Figure 2:
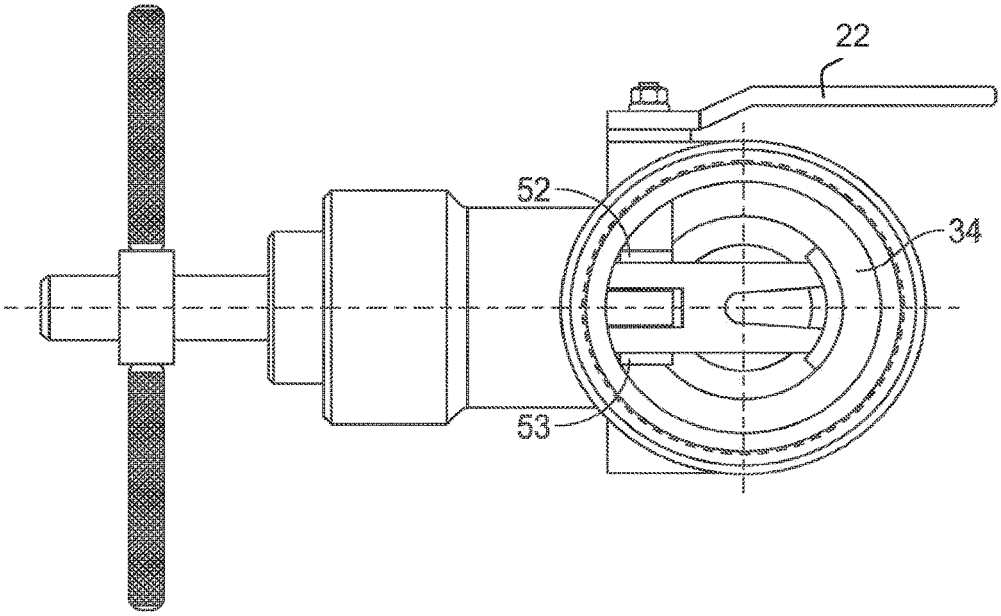
FIG. 2 is a schematic top view of the exemplary Tool Trap shown in FIG. 1.
Figure 3:
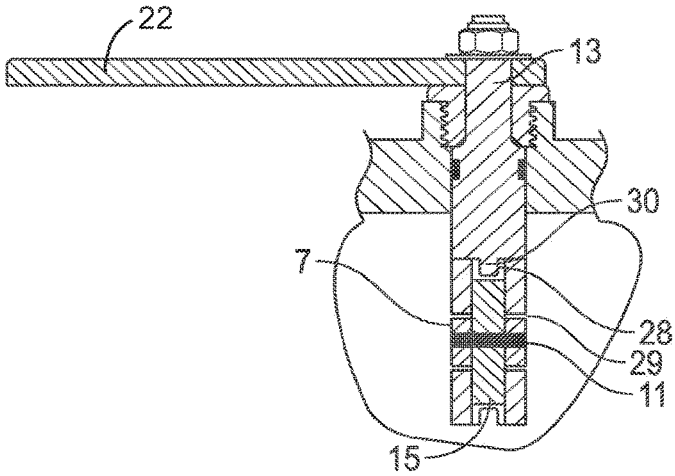
FIG. 3 is a schematic horizontal cross sectional view of a connection between a Gate Axle and a Flag Lever.
Figure 4:
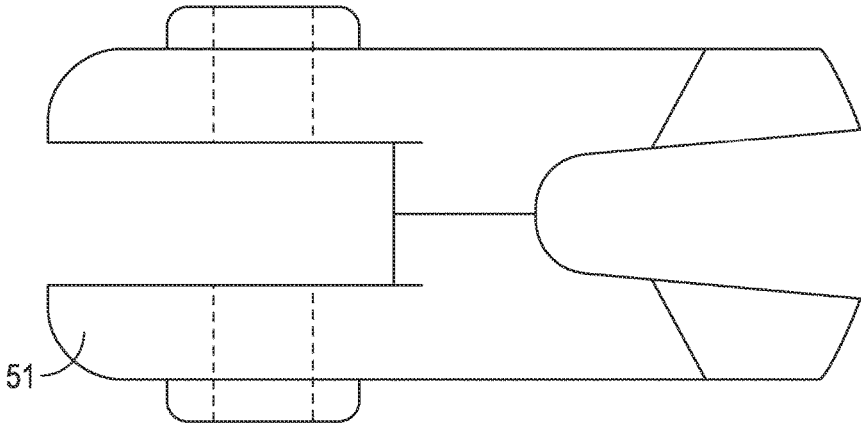
FIG. 4 is schematic top view of an exemplary Gate.
Figure 5:
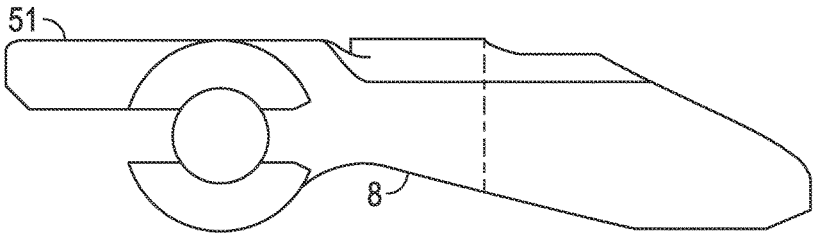
FIG. 5 is a schematic side view of the exemplary Gate of FIG. 4.

FIG. 1 is a schematic vertical cross sectional view of an exemplary Tool Trap in accordance with the present invention. FIG. 2 is a schematic top view of the exemplary Tool Trap shown in FIG. 1. FIG. 3 is a schematic horizontal cross sectional view of a connection between a Gate Axle (15) and a Flag Lever or shaft (13). FIG. 4 is schematic top view of an exemplary Gate. FIG. 5 is a schematic side view of the exemplary Gate of FIG. 4. The figures will be described in conjunction with each other. The Tool Trap is made of materials and dimensioned to withstand test pressures prescribed by API Standards, and sealing means may be such as conventional O-Rings or chevron-type sealing rings. Body (1) is configured to mate and seal with Pin connection (12), bottom Part (17), and Gate Retraction Assembly (100). Gate (8) is rotatable attached to Rod Eye (7) by Axle (15), the Axle being held in position with the Rod Eye by means of a Dowel Pin (11). The Body (1) has a first bore (19) in which the Gate can rotate between an open position and a closed position over a second bore (9).

The Gate Retraction Assembly (100) comprises: Bushing (4), Rod Eye (7) affixed to the end of threaded Rod (6) that seals, such as at location (3), with the bore (54) of Leveler (10) and engages female threads of Rod Guide (2) with Rod screw threads (14), such that the Rod Guide can be rotated to withdraw the Stem and Gate (8) laterally, from operating position shown in FIG. 1, to allow debris on top of the Gate that was preventing the Gate from opening, to fall into the Sump (34) that is formed around at least a portion of the Center Tube (25). The Rod Guide (2) may be turned by Handle (20) while thrust bearings, such as at location (5), prevent axial movement of the Rod Guide and reduce torque to a desired magnitude. The bearings and seals may be lubricated in a conventional manner as by Grease Fitting (21).

When the Handle is being rotated to move the Gate, the mating Flat Surface (50) of the Leveler prevents rotation of the Gate that maintains the Gate in a level position, restricting the Gate Retraction Assembly (100) to axial movement only. To prevent the Gate Nose (27) from dropping below a horizontal position while it is retracted, surface Lug (51) projects from the upper portion of the Gate distal from the Gate Nose to slide along the flat surface of the Leveler, such that the Gate Nose cannot rotate below a horizontal position, to ensure the Gate Nose will ride over and on to the Center Bore Top Surface (26).

To stop lateral movement of the gate at the precise operating position, Lug (37) may be formed on the lower side of the Rod Eye to contact the outer wall of Center Tube (25) without affecting rotation of the Gate between open and closed position.

When a retracted Gate (8) is being returned to operating position, Transverse Groove (28) in the side of the Gate Hinge (29) automatically engages Tang (30) formed on the end of Flag Shaft (13) to allow rotation of the Gate (8) via the Flag Shaft (13), such that when the Gate (8) is in operating position, the Gate (8) can be rotated between open and closed position by rotating the Flag Handle (22). Likewise, disengagement of the Tang (30) and Groove (28) is automatic when the Gate (8) is retracted.

The Gate Hinge may be held concentric with Bore (31) within the Gate Assembly Housing (32) by sliding contact between Bore (31) and Beveled Corners (52, 53) on the Gate Hinge, to eliminate bending of the Rod, there being only enough clearance between the Rod Eye (7) and Bore (31) to allow a sliding fit.

When the Gate (8) is in an operating position, it can be held closed by its weight plus weight of the Flag Handle (22), but it can easily be moved to the open position by a rising tool that lets it pass, or by manual rotation of the Flag Handle (22) to allow lowering a tool downhole. It is preferred that the Flag Handle (22) be horizontal when the Gate (8) is closed, and that it be in a vertical position when the Gate (8) is open.

Without departing from the spirit of the invention, retraction of the Gate may be done remotely by replacing the Hand Wheel Collar (16) with a rotary actuator or replacing the Rod (6) with a conventional hydraulic cylinder. Also, actuation of the Gate may be accomplished by attaching a rotary actuator to the Flag Shaft (13), or by attaching a hydraulic cylinder to the Flag Shaft.

Other and further embodiments utilizing one or more aspects of the invention described above can be devised without departing from the spirit of Applicant's invention. For example, other types of valves, restrictors, check valves, chambers, configurations for normally open and normally closed, different shapes cages and spools, and return mechanisms after actuation, as well as other variations can occur in keeping within the scope of the claims.

Discussion of singular elements can include plural elements and vice-versa. References to at least one item may include one or more items. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include, without limitation, integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of an exemplary embodiment. Obvious modifications and alterations to the described embodiment are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalents of the following claims.

What is claimed is:

1. A tool trap, comprising:

a body with a first bore and a second bore;

a rotatable gate positioned to selectively open and close within the first bore and over the second bore; and a gate retraction assembly affixed to the body and comprising:

a leveler having a leveler bore;

a rod eye affixed to the gate and disposed in the level or bore; and a rod extending along a first axis, wherein the rod is affixed to the rod eye and is configured to actuate the gate laterally between an operating position across the second bore and a retracted position away from the second bore;

wherein the gate is rotatable about a second axis that is disposed at an angle relative to the first axis.

2. The tool trap of claim 1, wherein the rod is configured to retract the gate into the leveler bore.

3. The tool trap of claim 2, further comprising a rod guide rotationally coupled with the body and comprising screw threads, and wherein the rod comprises mating screw threads that mate with the screw threads of the rod guide.

4. The tool trap of claim 3, wherein the gate is retractable by rotation of the rod guide to cause the rod to move laterally.

5. The tool trap of claim 1, wherein the gate comprises a gate nose and the gate is configured to prevent the gate nose from dropping below a horizontal position when the gate is actuated from the operating position to the retracted position.

6. The tool trap of claim 1, further comprising a center tube formed around the second bore, wherein the rod eye is configured to prevent the gate from travelling past the operation position when the gate is actuated from the retracted position to the operating position.

7. The tool trap of claim 1, further comprising a sump formed around the second bore and configured to receive debris in the body.

8. The tool trap of claim 1, further comprising a flag shaft selectively coupled to the gate to allow rotation of the gate via the flag shaft when the gate is in the operating position.

9. A tool trap, comprising:

a body with a first bore;

a rotatable gate positioned to selectively open and close over the first bore; and a sump formed around the first bore and configured to receive debris in the body; and a center tube formed around the first bore with the sump formed around the center tube;

wherein the sump is exposed to the first bore when the gate is closed over the first bore.

10. The tool trap of claim 9, further comprising a pin removably connected with the body in a second bore of the body that is larger than the first bore, wherein the pin is configured to be disconnected to remove debris from within the body.

11. The tool trap of claim 9, further comprising:

a gate retraction assembly affixed to the body and comprising a leveler having a leveler bore;

a rod eye affixed to the gate and disposed in the leveler bore; and a rod affixed to the rod eye and configured to actuate the gate laterally between the operating position and the retracted position.

12. The tool trap of claim 9, wherein the gate comprises a gate nose and the gate is configured to prevent the gate nose from dropping below a horizontal position when the gate is actuated from the operating position to the retraced position.

13. The tool trap of claim 9, wherein a top of the gate is sloped to deflect debris when the gate is in the operating position.

14. A method of restricting debris from entering a well, comprising:

coupling a tool trap to the well having a body with a first bore and a second bore; a rotatable gate positioned to selectively open and close within the first bore and over the second bore; and a gate retraction assembly affixed to the body, with the gate retraction assembly comprising a leveler having a leveler bore; a rod eye affixed to the gate and disposed in the leveler bore; and a rod affixed to the rod eye; and enabling an operator to selectively move the gate laterally along a first axis between an operating position across the second bore and a retracted position away from the second bore and rotationally about a second axis that is disposed at an angle relative to the first axis.

15. The method of claim 14, further comprising diverting debris into a sump formed around the second bore.

16. The method of claim 14, further comprising selectively coupling a flag shaft to the gate and enabling an operation to rotate the gate via the flag shaft when the gate is in the operating position.

* * * * *